US005918790A

United States Patent [19]

Donnell

[11] Patent Number: 5,918,790

[45] Date of Patent: Jul. 6, 1999

[54] STAPLING GUN ADAPTER RESTRAINING LOOSE LINEAR ENTITIES

[76] Inventor: Robert D. Donnell, 6112 County Rd. 55, Gibsonburg, Ohio 43431

[21] Appl. No.: 09/141,038

[22] Filed: Aug. 27, 1998

[51] Int. Cl.[6] ..... B25C 7/00

[52] U.S. Cl. ..... 227/151; 227/119; 227/140; 227/150; 227/156

[58] Field of Search ..... 227/150, 151, 227/140, 119, 120, 132

[56] References Cited

U.S. PATENT DOCUMENTS

| | | | |
|---|---|---|---|
| 2,637,030 | 5/1953 | Wickman et al. | 227/151 |
| 2,746,043 | 5/1956 | Heller | 227/132 |
| 3,283,986 | 11/1966 | McKee | 227/151 |
| 3,305,156 | 2/1967 | Khan | 227/132 |
| 3,476,301 | 11/1969 | Auston | 227/156 |
| 4,821,937 | 4/1989 | Rafferty | 227/142 |
| 5,014,896 | 5/1991 | Reitmeier et al. | 227/150 |
| 5,660,315 | 8/1997 | Beavers et al. | 227/151 |

*Primary Examiner*—Scott A. Smith

[57] ABSTRACT

A twin line-guide adapter easily affixed to the lower narrow front face of popular hand-held stapling guns. The two independent spring-loaded line-guides stabilize flexible, loose, linear entities such as wires, cables, cords or braids. This restraint is accomplished automatically by either line-guide extending or retracting, compensating for the tipping or slipping of the stapling gun, preventing damage to the linear entity from either leg of the driven staple. Each or both line-guides can be quickly thumbed to hold-up detent position or equally fast, shifted down for line-guide function. Both up on detent provides for immediate flat-entity stapling with neither wear on, nor interference by, the adapter.

8 Claims, 5 Drawing Sheets

STAPLING GUN ADAPTER RESTRAINING LOOSE LINEAR ENTITIES

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention is directed to popular hand-held stapling guns, especially the common squeeze lever-to-handle types to drive the staples.

Particular problems arise when this same stapling operation is employed to affix flexible, loose, linear entities to suitable interior or exterior surfaces. One problem is caused by the linear entity imparting an unstable variation to the normal perpendicular relation of the stapling gun to the flat surface to which the linear entity is being stapled.

This rather constant problem is too frequently worsened by the stapling gun's precipitous unloading of the staple driving spring energy, the input from the operator's squeezing hand. The resulting recoil at that moment may cause the staple ejecting front area of the stapling gun to suddenly slip some-what sideways. In untold numbers, one leg or the other of the resulting misplaced staple has seriously damaged the linear entity.

A prominent scenerio of these negative events has been incurred stapling interior single-cable telephone lines in existing houses' attics or crawl spaces. Another, and with an enormously higher incidence, is in stapling exterior multi-wire Christmas miniature or the larger light-bulb strings. The damage probabilities to the wires increase dramatically when the operator, male or female, of necessity, staples from a ladder and/or in less than ideal weather.

When the electric function is energized and a weakened or severed conductor is then apparent, the only options are either total replacement or a very difficult linear repair.

REVIEW OF THE PRIOR ART

Professional research indicates seven United States patents spanning Jun. 9, 1942 through Aug. 26, 1997 pertaining to the protective stapling of a linear entity. The list follows:

| Name | Mo./Day/Yr. | U.S. Pat. No. |
|---|---|---|
| 1. J. J. Harley | 6-09-1942 | 2,285,512 |
| 2. H. S. Heller | 2-09-1954 | 2,668,290 |
| 3. F. King | 7-17-1956 | 2,754,515 |
| 4. H. A. Flammer | 1-01-1957 | 2,775,763 |
| 5. J. A. Khan | 2-21-1967 | 3,305,156 |
| 6. W. Sheng | 11-12-1985 | 4,552,296 |
| 7. Beavers et al. | 8-26-1997 | 5,660,315 |

Each of these patents seem oriented almost exclusively to the stapling of a single wire or, more notably, interior sheathed telephone cable to new structural surfaces. Within this limitation they doubtlessly achieve measurable success. However, in existing confining attics and crawl spaces their effectiveness could be severely limited. The reason for this is their mutual rigidity whether in mechanical adjustment of an adapter or factory-formed grooves under particular stapling guns. Similarly, they could hardly aid in the stapling of soft, very flexible cords or braids involved in craft-work. Finally, one tries to imagine any of these patents meaningfully assisting in stapling exterior, multi-wire Christmas light strings. Any inadvertent tipping of the stapling gun could result in loss of restraint to one of the small wires and possible cutting of the conductor. Obviating these serious problems is exactly what the present invention is designed to accomplish.

BRIEF SUMMARY OF THE INVENTION

The present invention comprises an adapter easily affixed through peel and stick means to the narrow front lower face of popular hand-held stapling guns. The purpose of the adapter is to restrain flexible, loose, linear entities. Common examples are wires, cables, cords or ornamental braids. This restrainment prevents damage to the linear entity from either leg of the driven staples. It is effectively accomplished by two independent spring-loaded line-guides. After quick, simple positioning over the linear entity, should the stapling gun be inadvertently tipped or shifted, the line-guides automatically compensate for the error. This positive, protective restraint is achieved by either line-guide compressing or extending as the case may be. Especially applicable is the safe staple-fastening of exterior multi-wire Christmas light strings. Furthermore, either or both line-guides can be quickly thumbed up to holding detent position providing for immediate flat-entity stapling. Conversely, each or both can be thumbed off detent for nearly instant line-guide operation and protection.

DETAILED DESCRIPTION OF THE INVENTION

Figure 1:
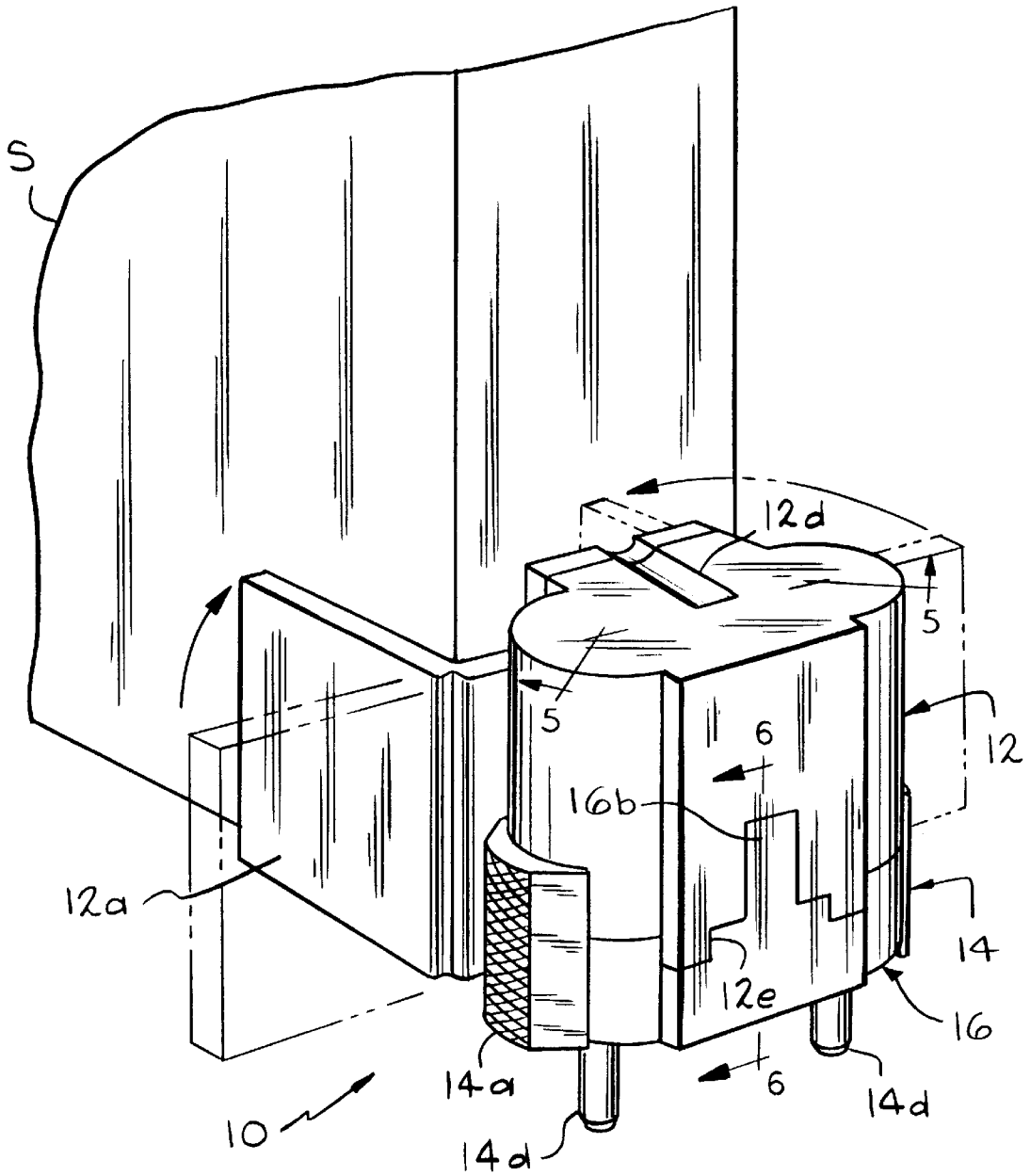
FIG. 1 is a perspective view showing the adapter of the present invention, and the particular function of hinge-bend folding side-wings in relation to a common, popular hand-held stapling gun.

This sheet contains a complete listing of the letters, numbers and combined numbers with letters of the eight drawing figures.

S STAPLING GUN

M MARK, INDEXING

CONDUCTOR, electric

10 ADAPTER, complete

12 BODY

12*a* Back including hinge-bend folding side-wings

12*b* Operating slot for connecting pin

12*c* Line-guide hold-up detent

12*d* Indexing groove to stapling gun

12*e* Stabilizing pin to base, four

12*f* Recess pocket for base attaching lugs, two

12*g* Blind cylinder bore, two

12*h* Peel and stick attaching means, three

14 LINE-GUIDE UNIT

14*a* Lift-cover

14*b* Connecting pin

14*c* Piston

14*d* Line-guide

16 BASE

16*a* Stabilizing pin indentation, four

16*b* Deflective attaching lug, two

16*c* Through hole, two

18 SPRING, two

Figure 2:
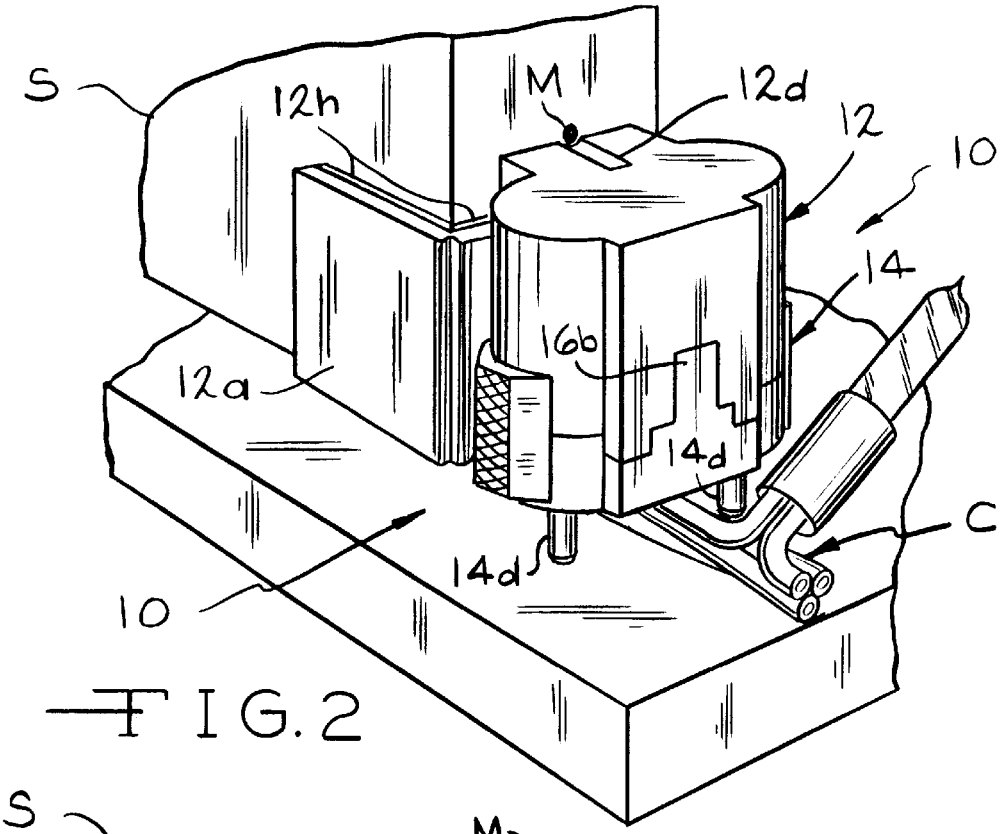
FIG. 2 is a perspective view of the adapter's effective restraint upon a typical exterior multi-wire miniature Christmas light cable.
Figure 3:
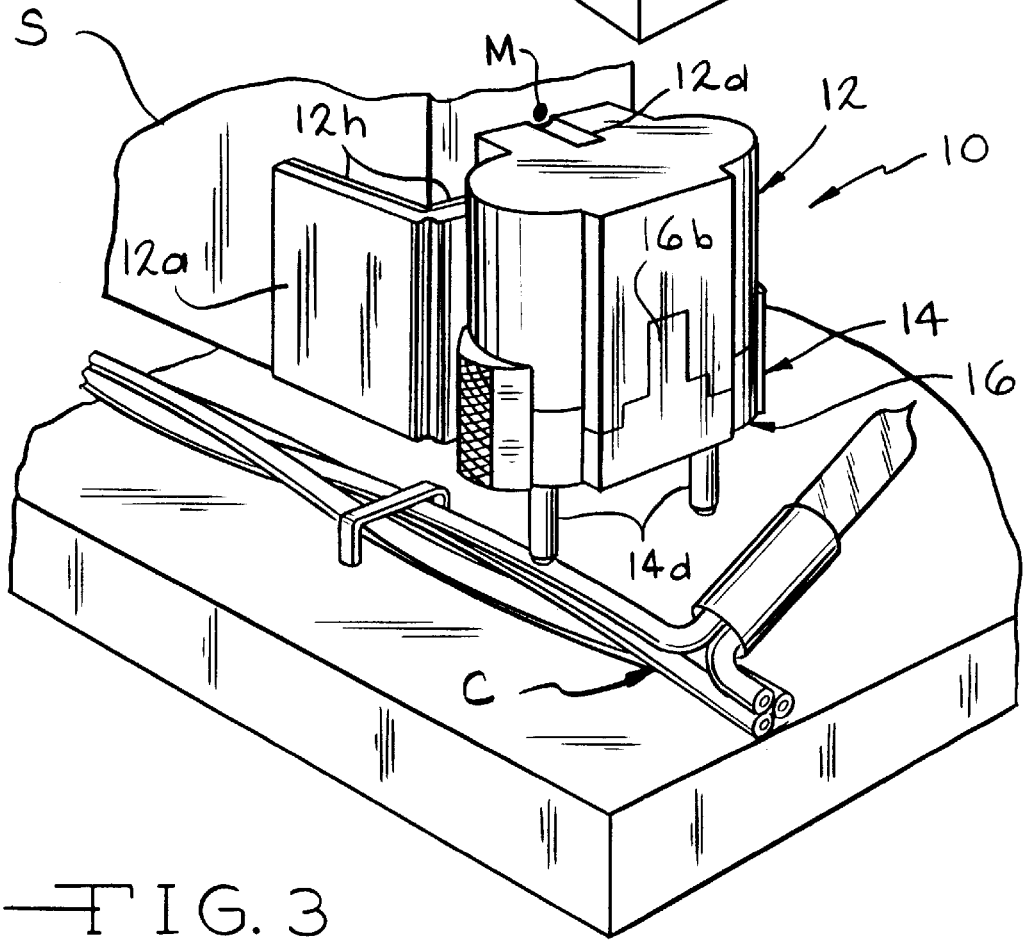
FIG. 3 is a perspective view sequential to FIG. 2 showing the above lights-cable confined safely between the legs of the driven staple.
Figure 4:
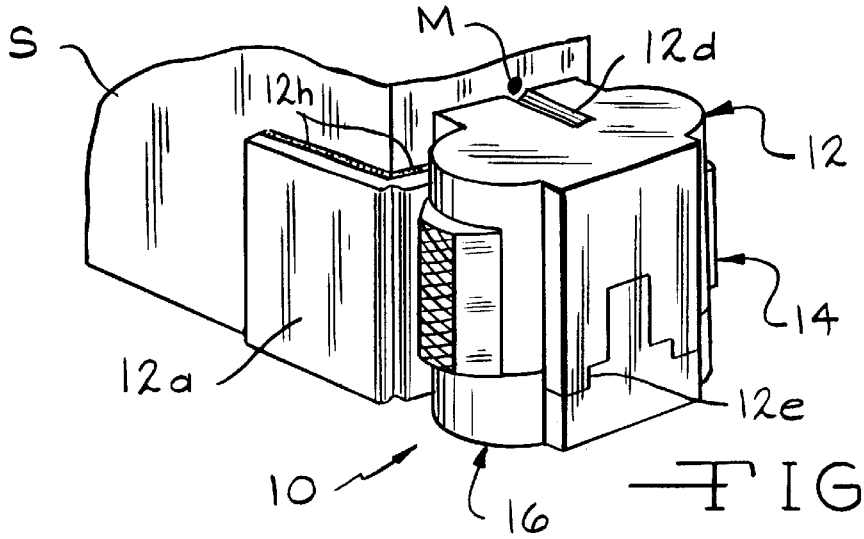
FIG. 4 is a perspective view of the adapter in non-operating mode.
Figure 5:
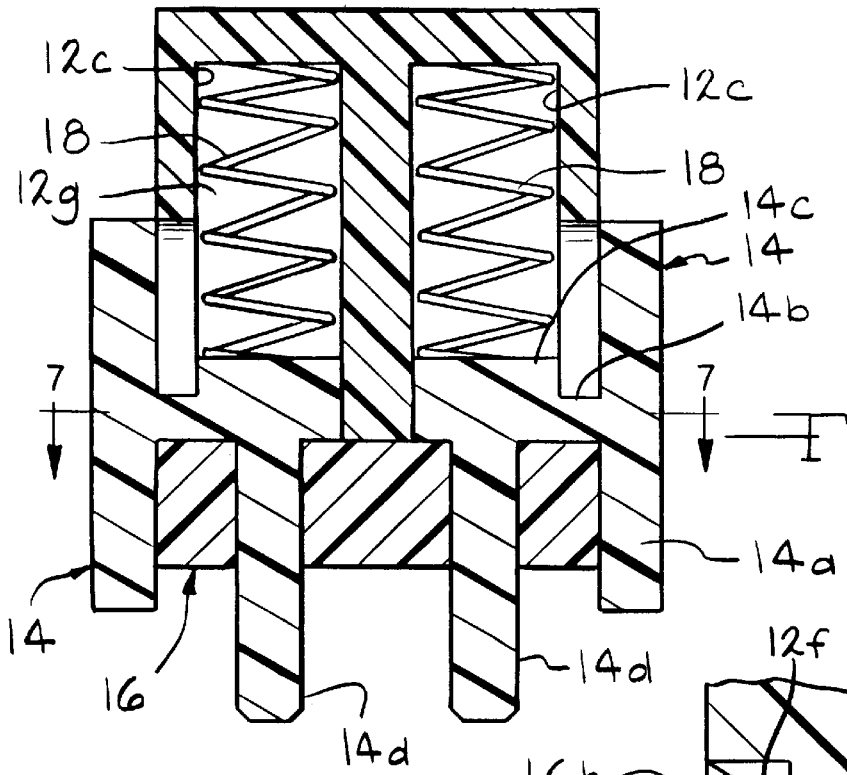
FIG. 5 is a vertical sectional view defined by lines 5—5 of FIG. 1 of the adapter's interior.
Figure 6:
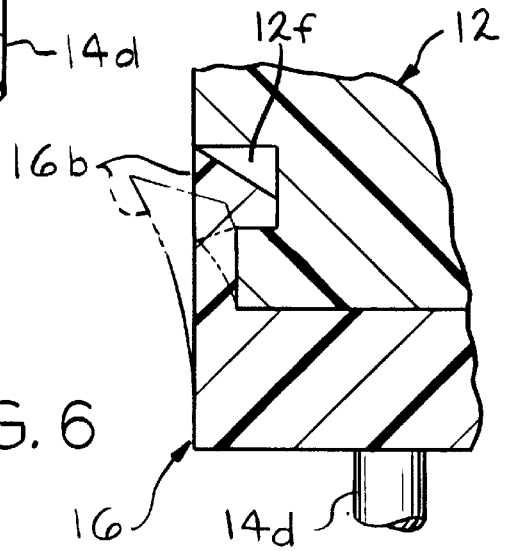
FIG. 6 is a section view along lines 6—6 of FIG. 1 illustrating no-tools assembly.
Figure 7:
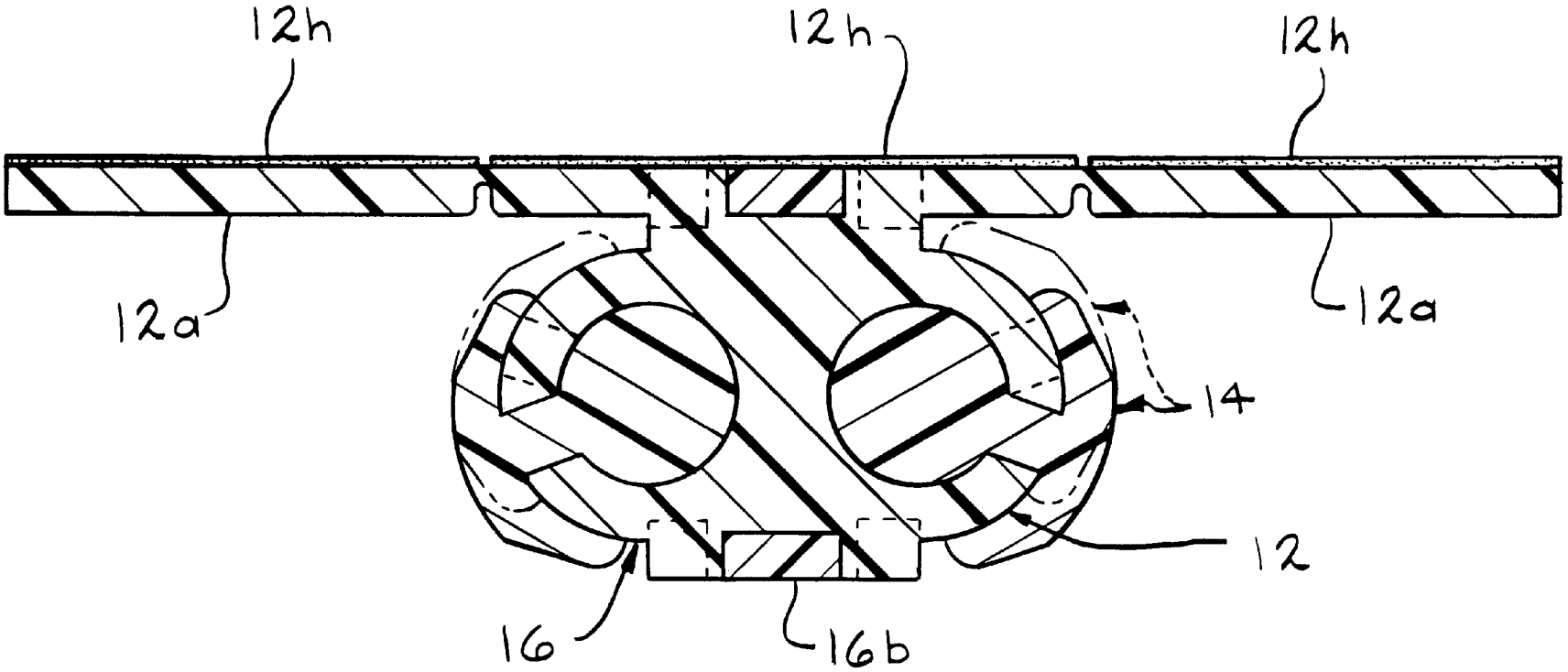
FIG. 7 is a cross section view along lines 7—7 of FIG. 5 showing especially, the positional change from operating to non-operating modes.
Figure 8:
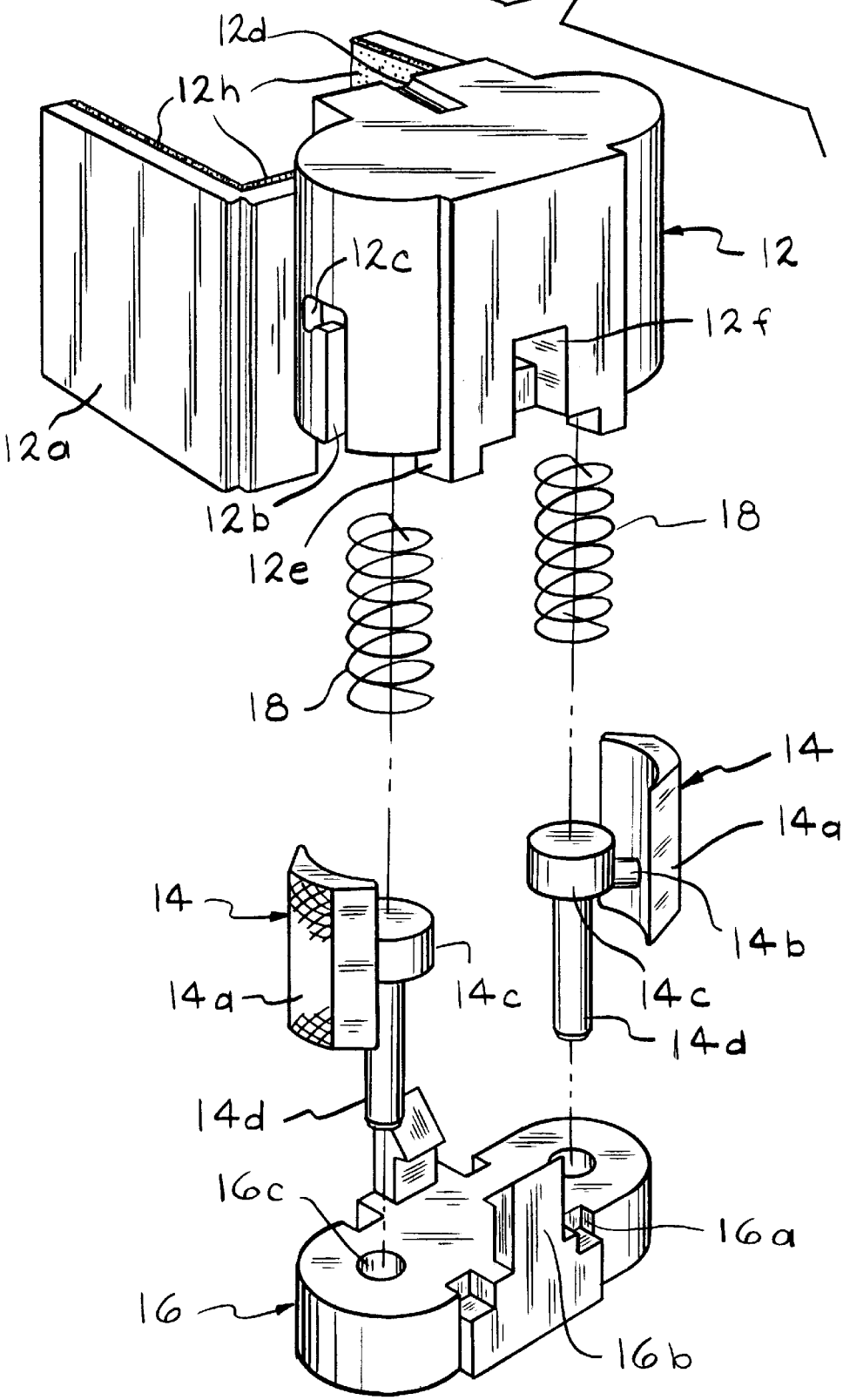
FIG. 8 is an exploded perspective view of the adapter parts, illustrating no-tools, sequential assembly.

In FIG. 1, provision for attaching adapter 10 of the present invention to stapling gun S is aided, in large part, by folding hinge-bend side-wings 12*a*. This view depicts side-wings 12*a*, in dashed lines, molded with body 12 and in solid lines, folded flat to their respective adjacent sides of stapling gun S. This view also shows body 12 hasp on top, an indexing groove 12*d* and on bottom, stabilizing pins 12*e*, plus line-guide units 14 including line-guides 14*d* and base 16 with front deflective attaching lug 16*b*. In FIG. 2, adapter 10 is shown affixed to stapling gun S utilizing indexing groove 12*d* to indexed mark M. The attachment is achieved by the mutual bond, each side, of three peel-and-stick rectangles, 12*h* applied one each to the back side of body 12 and side-wings 12*a*. In addition FIG. 2 depicts the operating mode position of adapter 10, with line-guides 14*d* partially, and independently, depressed in restraining the loosely woven electric conductors C of an exterior Christmas light string against a stapling surface. FIG. 3, sequential to FIG. 2, shows stapling gun S with adapter 10 lifted from conductors C, line-guides 14*d* in automatic full extension following the effective, safe restraint of conductors C between the legs of a driven staple. FIG. 4 shows adapter 10 affixed to stapling gun S, with line-guide units 14 elevated to hold-up detent position (12*b* and 12*c* of FIG. 8), providing for ordinary flat-entity stapling. FIG. 5, a vertical sectional view of lines 5—5 of FIG. 1, shows blind cylinder bores 12*g* containing two identical compression springs 18, and their position upon pistons 14*c* of two interchangeable line-guide units 14. This view also shows integral units 14 each having pin 14*b* connecting lift-cover 14*a* to piston 14*c* and line-guides 14*d* appearing in operating down mode through base 16. In FIG. 6, a sectional view determined by line 6—6 of FIG. 1, base 16 is shown with deflective attaching lug 16*b* rising in dashed lines, and in solid lines, after locking engagement into lug pocket 12*f* of body 12. Guide 14*d* shows only positional relationship in the drawing. FIG. 7, a cross sectional view of line 7—7 of FIG. 5, shows especially, the positional change of line-guide units 14 from solid line operating mode, to hold-up detent non-operating mode in dashed lines. Base 16 is indicated with deflective attaching lug 16*b* at the juncture with body 12. Also depicted for illustration, on this view, are peel-and-stick attaching means 12*h* to body 12 back and to each side-wing 12*a*. FIG. 8, an exploded perspective view of the entire adapter, defines graphically all parts previously described and with utmost clarity line-guide units 14 comprising four functional elements: lift-covers 14*a*, connecting pins 14*b*, pistons 14*c* and line-guides 14*d*. Equally important is shown operating slot 12*b* providing for reciprocal movement of line-guides 14*d* through connecting pins 14*b* and unit 14's up and rearward holding detent position 12*c*. FIG. 8 also illustrates base 16 having four indentations 16*a* which receive body stabilizing pins 12*e*, two through holes 16*c* allowing movement for, and lending stability to, line-guides 14*d*. In addition, FIG. 8 shows the two base 16 attaching lugs 16*b* to body 12 recess pockets 12*f*, providing assembly of adapter 10 without tools.

In view of this portion of the Description concerning parts and their relationship to each other, four objects and advantages become manifest.

1. The interchangeability of the two line-guide units 14, requiring only one die-mold for manufacture.

2. The identical two compression springs 18, providing for a one part-number order and supply.

3. The simplicity of a six-part, no tools required, assembly of the adapter, conceivably kit-form.

4. The facility of peel-and stick attaching means, enabling a typical homeowner, or other operator, to affix this adapter to an existing or new common hand-held and nearly always operated stapling gun, also without needing tools.

OPERATIONS

Operation of adapter 10 would necessarily begin with the typical individual's attachment of adapter 10 to his or her's stapling gun S, both shown on FIGS. 1, 2, 3 and 4. This fundamental step is conveniently achieved through three peel-and-stick rectangles shown similarly as 12*h* on FIGS. 2, 3, 4 and in cross section FIG. 7.

First, one would place stapling gun S in upright operational position on a hard, flat surface such as a common table or counter top. Then the line-guide units 14 of adapter 10 would be thumbed-shifted up and immediate rearward to hold-up detent position, FIG. 4, utilizing operating slots 12*b* and line-guide detents 12*c* of FIG. 8. This provides for adapter 10 an equally flat bottom surface as stapling gun S as shown in FIG. 4. Wihout removing any protective cover from the three peel-and-stick rectangles 12*h* of FIGS. 2, 3 and 4, the middle rear 12*h* of adapter 10 is slid against the narrow, lower front face of stapling gun S. Each of their bottom surfaces are maintained in a planar relation by virtue of the hard flat surface upon which they are positioned. Still without removing any peel-and-stick cover protection, the two hinge-bend folding side-wings 12*a*, FIG. 1, are pinched back equally along their adjacent sides of stapling gun S. This action centers adapter 10 to the bottom longitudinal axis of stapling gun S assuring the measurement between line-guides 14*d* is equidistantly just less than the measurement between the legs of a driven staple. Viewing FIGS. 2, 3 and 4, using a suitable marker such as a felt-tip pen, a noticeable indexing mark M is made on stapling gun S at the juncture of indexing groove 12*d* on top of adapter top to stapling gun S. The cover of the middle, or backside, peel-and-stick rectangle 12*h* is then removed and adapter 10 is carefully slid against stapling gun S while keeping indexing groove 12*d* in alignment with indexing mark M on stapling gun S. Adapter 10 is then pressed firmly against stapling gun S from the front of body 12 to assure overall uniform bonding. Continuing, a cover is removed from one folding-hinge side-wing 12*a* and this side-wing is pressed progressively with a stretching movement, front to rear, around the corner to the adjacent side of stapling gun S, preventing any slack at the folding hinge-bend. The identical proceedure is employed to the opposite side-wing 12*a*, completing attachment of adapter 10 to stapling gun S. For clarity, it should be noted only one hinge-bend indentation is shown on FIGS. 1, 2, 3, 4, 7 and 8 for side-wings 12*a*, whereas a plurality of these fine indentations, each about one millimeter apart, would be molded to facilitate attaching adapter 10 to existing, or new, common hand-held stapling guns having slighly different narrow front face widths.

As described above with adapter 10 securely attached to stapling gun S and shown in FIG. 4, any ordinary, flexible linear entity that has been conventionally staple-fastened before, and too often compromised, can now be fastened with new-found assurance. Utilizing the restraining advantage of adapter 10, the linear entity will be protected from the legs of a driven staple. The first operation would be placing the twin line-guides 14*d* in down, or exposed, operating position pictured in FIG. 1. This action, realistically in the ten second range, time-wise, is conveniently accomplished by the operator, using a thumb-tip, pressing one lift-cover 14*a* of FIG. 1, just up out of hold-up detent 12*c* and about two millimeters front-ward to operating slot 12*b*, both shown on FIG. 8. At this point, relaxing the thumb, inherent pressure of spring 18, bearing upon piston 14*c*, extends line-guide 14*d* to full operating length, guided by through holes 16*c* of base 16, FIG. 8, and seen clearly in cross-section FIG. 5. The same simple maneuver is enacted to the opposite side unit 14. These two preparatory steps introduce, rather innocently, the most fundamental feature of adapter 10. This is the absolute, independent and automatic, spring-loaded function of each line-guide 14*d*, whether used singly or in unison, to assist and protect for different stapling purposes. This consideration is addressed constructively and unambiguously in FIG. 8 and in depiction and obvious deduction in the selected application of FIG. 2. This FIG. 2 pictures both line-guides 14*d* in operation, placed astraddle conductors C of a three wire factory twisted, or woven, miniature Christmas light string. In recent years the fastening of exterior Christmas light strings has evolved into a most common, and frustrating, annual stapling chore. This is, in large part, because the popular miniature Christmas light strings are of relatively recent development, though most assuredly, of wide-spread use. In FIG. 2, the unstable surface afforded the stapling gun by these conductors C, collectively, is quite observable. At the same time, one can perceive that at any time during the stapling cycle that adapter 10, with stapling gun S, tips or slips sideways, especially when the lever-to-handle "trips", line-guide 14*d* in the direction of the tip would automatically depress against spring 18 pressure. Oppositely, the other line-guide 14*d* would compensate by independently extending, each maintaining constant contact with the stapling surface, thereby restraining the shifting wires. As a consequence, FIG. 3 graphically portrays multi-conductors C safely fastened between the legs of a driven staple. The exploded view of the adapter in FIG. 8 is clearly indicative of single or twin line-guide functions, dependent solely upon the desire and intended use by the operator. The single line-guide option is preferable when the operator wants to use the stapling gun, with this adapter, in a sort-of side-gathering or raking motion to position a linear entity for staple fastening. This is a very viable solution, in certain places, even to fastening the Christmas light string illustrated, or similar use, when the stapling surface changes from horizontal to vertical, overhead, slanted or occasions when the view is partly obscured. The critical point is, this operator can switch back and forth from single to twin line-guide function, in just seconds, each time. This elective decision for using just one or both line-guides 14*d*, again eminently discernible in FIG. 8, would enhance the safe stapling of interior telephone cables and even apply to a craftsperson working with colored braid, picturesquely outlining a holiday, or other, motif upon a stapling surface. Important to note here, with both line-guide units 14 in quick hold-up detent position, 12*c* of FIG. 8 and shown in FIG. 4, the stapling gun S with adapter 10 attached, is immediately ready for any flat-entity staple fastening. The final drawing, FIG. 8, covers one more important detail. One notices each wire end of identical springs 18 is turned back across its own diameter. This assures whichever end is assembled into blind cylinder bore 12*g* of FIG. 5, the opposite wire end cannot wear down around the circumferential edge of piston 14*c* or damage the concave surface of blind cylinder bore 12*g*.

In the prefered embodiment, body 12, FIG. 8, with integral back and side-wings 12*a*, and line-guide units 14, and base 16 would be molded as three individual parts of a plastic-type material such as polyethylene, PTFE or perhaps a type of phenolic resin. In the same context, the three attaching means 12*h*, FIG. 7, would be commonly used, though high-grade, peel-and-stick picture-hanging tape. The two springs 18, FIG. 8, would be fabricated of a durable and spring-pressure maintaining metal.

Before leaving OPERATIONS, three additional and important objects and advantages should be noted:

1. The evident option of choosing either single, or both, line-guides to satisfy any flexible linear entity stapling situation.
2. The rapidity with which either single or twin line-guide functions can be changed, one function to the other, in most-likely, not more than ten seconds.
3. The positive advantage of thumbing from either single or twin line-guide function to hold-up detent position in a similar negligible time period, providing for flat-bottom, flat-entity stapling. This duality of purpose and function, provided by this adapter is maintained, ready and waiting, to the selection of the operator.

CONCLUSION, RAMIFICATIONS AND SCOPE

In addition to attaching the adapter of the present invention to a stapling gun by using typical peel-and-stick picture-hanging tape, different embodiments should be considered. Four of these relevant and available attaching means are as follows:

1. Any common contact cement
2. A two-part adhesive with part "A" being applied to the body backside and hinge-bend folding side-wings of the adapter, and part "B" being applied to the corresponding areas of the stapling gun. This option allows a little time for positional adjustment.
3. The recent availability of peel-and-stick, hook and loop fastening tape,, providing for the actual easy removal and reattachment of the adapter for any reason.
4. More solid attachment of the adapter to a stapling gun could be attained by including electric spot-welding, or drilled and tapped holes for machine screws. This probability is for adapters made of a compatible metal and intended for heavier duty or industrial use.

The material used to mold the adapter's body, lift-guides and base should not be limited to a plastic-type material. Other embodiments would include cast aluminum or zinc, including alloys thereof. A further distinct possibility would be the body and base being formed of plastic and the line-guide units cast in metal. Heavy or industrial use adapters could be cast, and/or milled, of steel including stainless steel, and with metal attaching means to the stapling gun, similar, but not limited to, those in number 4 above. These more costly adapters, likely, would have external dimensions commensurate with particular stapling gun models.

Understandably, possible other small changes of more or less relative importance could be made in materials or attaching means of the adapter, without departing from the spirit or scope of this inventions. An example would be the piston and line-guide formed as one part with the connecting pin press fitted to a hole in the piston and one in the lift-cover. Threaded means could be considered instead of press fitting.

I claim:

1. An adapter to restrain flexible, loose, linear entities for a common hand-held stapling gun comprising a body formed with integral back and two hinge-bend folding side-wings, said back and said side-wings of said body having surfaces with attachment means for securing said adapter to said stapling gun, said hinge-bend of each said side-wings having a vertical line indentation at a juncture of said back and each said side-wing, and a pair of independent line guide units, each unit comprising a lift cover, a piston, a connecting pin, and a line guide.

2. The adapter of claim 1, further including said attaching means being of a peel-and-stick type of dimensions equal to said body back and to a rearward side of each said side-wing.

3. The adapter of claim 1, further including said body having an indexing groove extending from a top center point of said body to a top point on a vertical center line of a back of said body, said groove providing means for allowing an alignment mark to be made on a front face of said stapling gun.

4. The adapter of claim 1, wherein said body further includes an operating slot on opposite sides of said body for receiving a respective connecting pin.

5. The adapter of claim 4, wherein each said slot has an upper horizontally extending portion for receiving said respective connecting pin therein, such that each line guide can be selectively maintained in an upper inoperative position.

6. The adapter of claim 1, wherein said body further includes side-by-side cylinder bores, each bore containing a spring for biasing each said respective line guide downwardly.

7. The adapter of claim 1, wherein said body further includes front and backside recess pockets, and further including a base having members received in said pockets.

8. The adapter of claim 1, further comprising a base at a lower portion thereof, wherein said body further includes stabilizing pins received in recesses in said base.

* * * * *